US007837246B2

(12) United States Patent
Gustavsson

(10) Patent No.: US 7,837,246 B2
(45) Date of Patent: Nov. 23, 2010

(54) DEVICE FOR HOISTING

(76) Inventor: Timar Gustavsson, Industrivägen 12, S-311 33 Falkenberg (SE)

( * ) Notice: Subject to any disclaimer, the term of this patent is extended or adjusted under 35 U.S.C. 154(b) by 636 days.

(21) Appl. No.: 11/792,583

(22) PCT Filed: Dec. 23, 2005

(86) PCT No.: PCT/SE2005/002044

§ 371 (c)(1),
(2), (4) Date: Jun. 8, 2007

(87) PCT Pub. No.: WO2006/071189

PCT Pub. Date: Jul. 6, 2006

(65) Prior Publication Data

US 2008/0143131 A1 Jun. 19, 2008

(30) Foreign Application Priority Data

Dec. 27, 2004 (SE) ..... 0403179

(51) Int. Cl.
*B66C 1/66* (2006.01)

(52) U.S. Cl. ..... 294/81.53; 294/81.1

(58) Field of Classification Search ..... 294/81.1, 294/81.2, 81.21, 81.53
See application file for complete search history.

(56) References Cited

U.S. PATENT DOCUMENTS 3,501,193 A * 3/1970 Gray ..... 294/81.53
3,980,185 A * 9/1976 Cain ..... 206/509
5,163,726 A * 11/1992 Boos et al. ..... 294/81.1
5,236,238 A 8/1993 Barnett et al.
6,135,524 A 10/2000 Faller et al.
7,175,216 B1 * 2/2007 Tong et al. ..... 294/81.1

FOREIGN PATENT DOCUMENTS

EP 0639527 A1 2/1995
SE 504415 C2 2/1997

* cited by examiner

*Primary Examiner*—Dean J Kramer
(74) *Attorney, Agent, or Firm*—McGinn IP Law Group, PLLC

(57) ABSTRACT

The present invention relates to a device in intermediate- or extension pieces, which are often designated for example middle yoke, frame, etc., for interconnection with a goods handling or hoisting device which is often designated, for example, yoke, 5 spreader etc. so as to permit handling or hoisting of goods platforms which are often designated flats, flat racks, etc., with corner boxes for cooperation with twist locking pins (V) of the goods handling or hoisting device, the intermediate- or extension pieces being in the form of a beam arrangement in the form of two mutually interconnected ends (5, 6) with one leg (1, 2, 3, 4) at each end, a twist locking 10 pin (13) being disposed in each leg (1, 2, 3, 4) and there being disposed, at one end of each leg, a part (60, 61, 62, 63) switchable in a direction up out of the leg (1, 2, 3, 4) for actuating a mechanism for twisting the twist locking pin (13) in the leg (1, 2, 3, 4) on switching of said part (60, 61, 62, 63) in a direction up out of the leg (1, 2, 3, 4).

20 Claims, 7 Drawing Sheets

DEVICE FOR HOISTING

The present invention relates to a device according to the preamble to appended claim 1.

In many contexts, it is desirable to be able to supplement conventional goods handling equipment of the so-called spreader type for handling containers and conflats with a view to being able to employ the goods handling equipment for handling flats which have corner boxes with holes for cooperation with rotary locking pins of the so-called twist lock type. To this end, legs, or extensions, have been developed which are normally interconnected to one another via a beam arrangement to form a four-legged intermediate- or extension piece which has two mutually interconnected ends with a leg at each end and a telescopic web beam interconnecting the end pieces for adaptation to different lengths of the goods handling equipment and the loads (the flats). However, extremely strict safety requirements are placed on the coupling between the lifting device or hoist and the four-legged intermediate- or extension piece. Thus, it is necessary that the safety aspects of the twist lock pins in the goods handling equipment proper be transferred to the twist lock pins of the intermediate- or extension piece so that the handling or hoisting of goods on flats and the like without ends but with corner boxes for cooperation with the twist lock pins takes place with the same level of safety as the handling of goods in containers and goods on flats with fixed or pivotal end walls. Moreover, there is a major need in the art for a device for automatic switching of the twist lock pins in the legs by means of the twist lock pins on the goods handling or hoisting equipment without any reduction in the locking safety which is required for safe and secure handling of the goods. Further, there is a need in the art that the device permit handling or hoisting of the intermediate- or extension piece by means of different types of goods handling equipment, for example good handling devices which twist the twist lock pins clockwise and goods handling devices which twist the twist lock pins counter-clockwise.

The task forming the basis of the present invention is to realise a device for handling or hoisting of goods of the type which satisfies the above-outlined needs.

This task is solved according to the present invention in the device indicated by way of introduction in that the device has been given the characterising features as set forth in the appended Claims.

The present invention thus realises a device with safe, reliable and unambiguous interconnection of a goods hoisting of handling device of the spreader type with an intermediate- or extension piece, a so-called middle yoke, with complete transfer of the safety aspects from the goods handling or hoisting device to the intermediate or extension piece. This interconnection moreover takes place wholly automatically without any reduction whatever in safety aspects. Further, a twisting of the locking pins will be prevented if any of the locking pins on the middle yoke is locked for any reason. Moreover, the device according to the present invention permits handling or hoisting by means of different types of goods handling devices or parent yokes. Thus, the device according to the present invention permits automatic handling or hoisting by means of twist locking pins which are twisted clockwise or counter-clockwise. The device according to the present invention imparts to the middle yoke an automatic and universal nature without any reduction whatever in safety.

One embodiment of the present invention will now be described in greater detail hereinbelow with reference to the accompanying Drawings.

Figure 1:
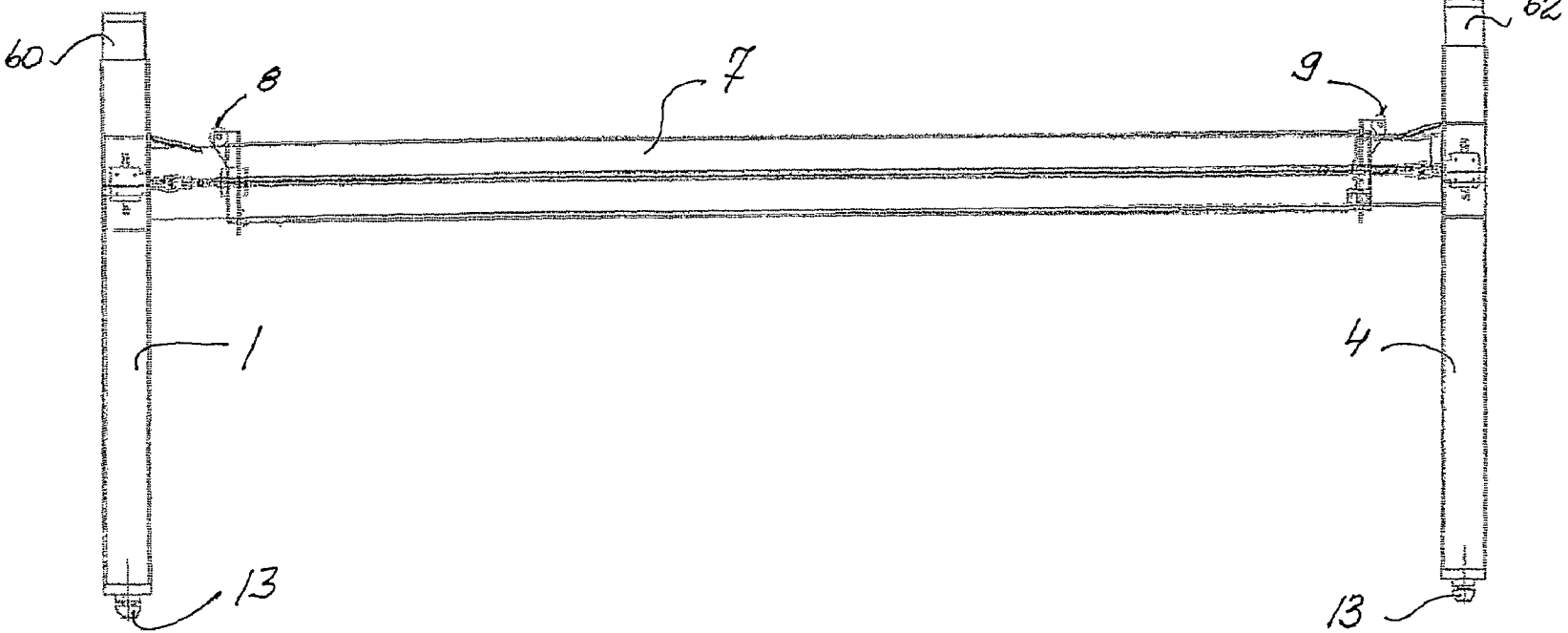
FIG. 1 is a side elevation of an intermediate- or extension piece according to one embodiment of a device according to the present invention.
Figure 2:
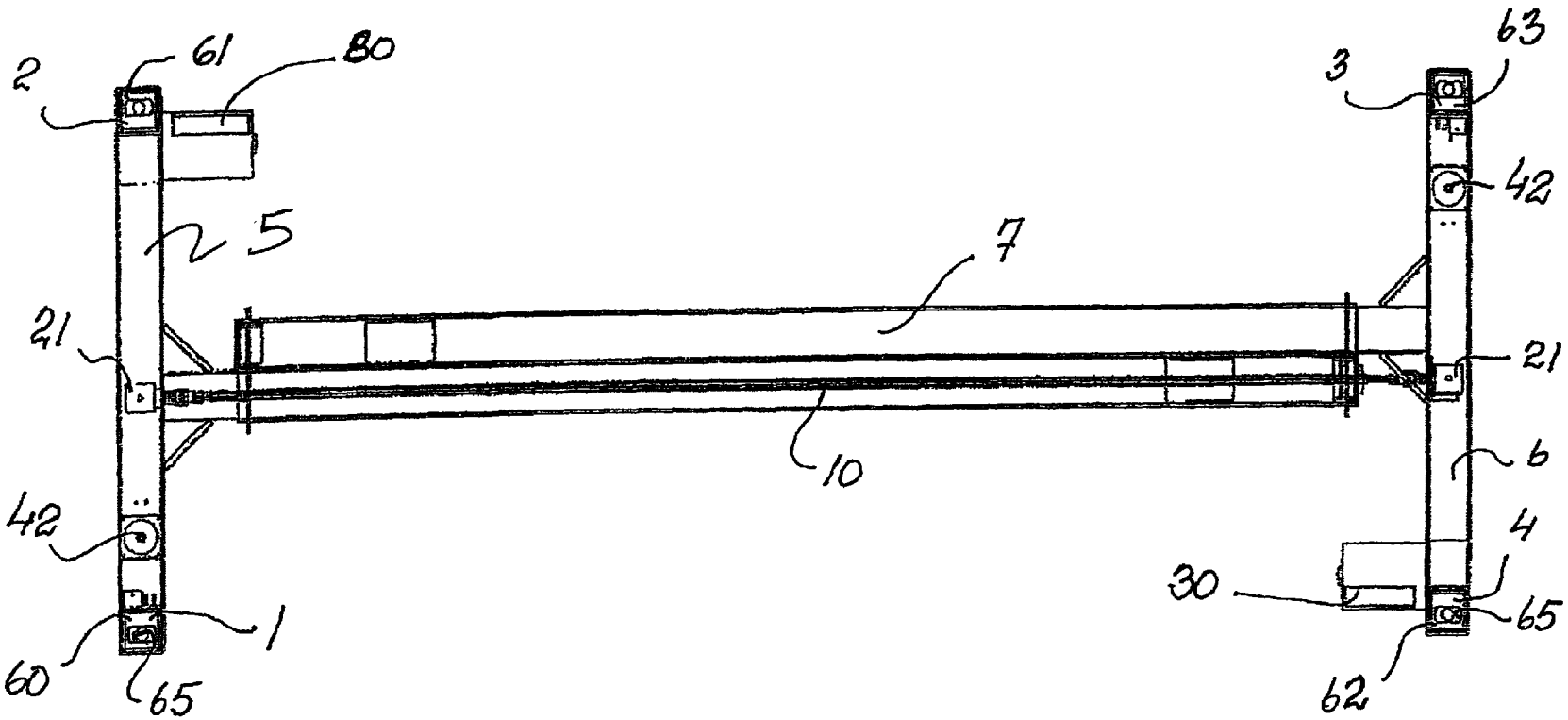
FIG. 2 is a top plan view of the intermediate- or extension piece of FIG. 1.
Figure 3:
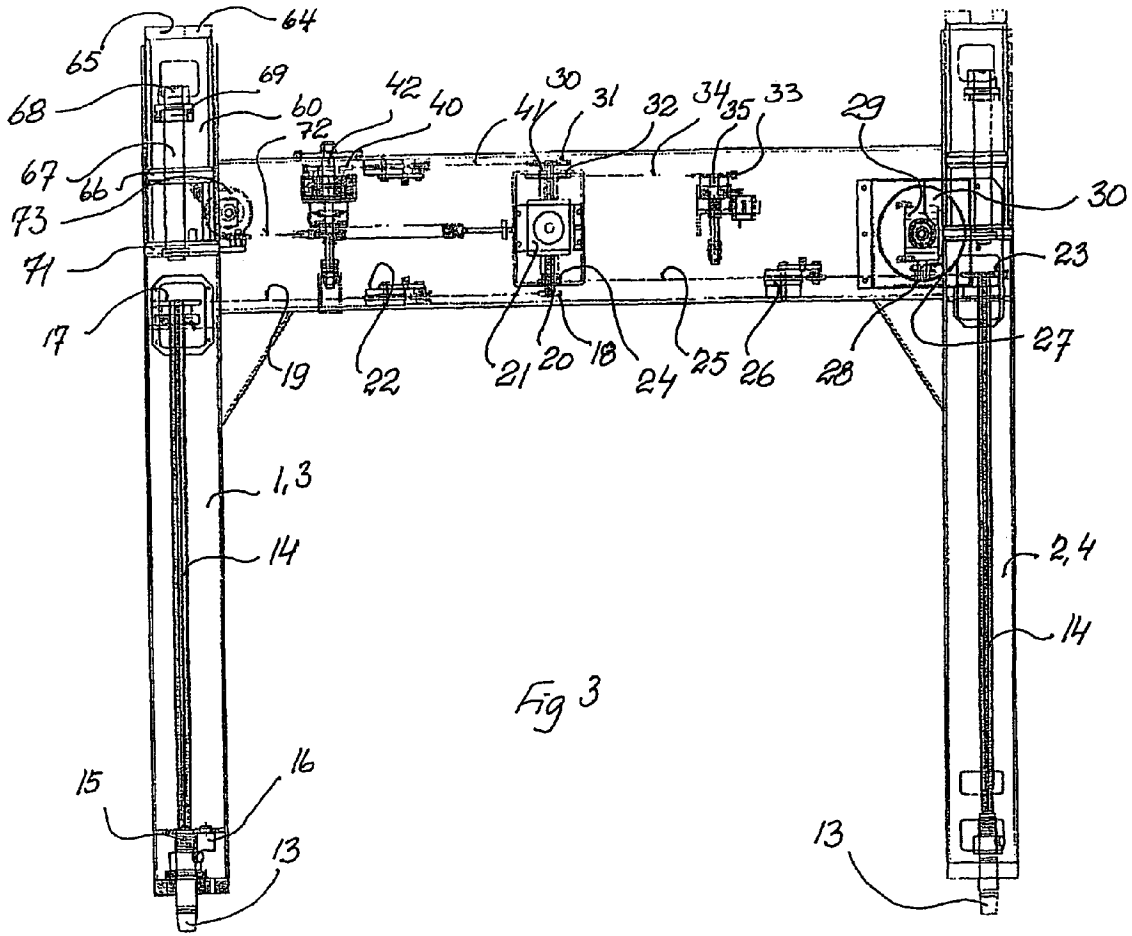
FIG. 3 shows, on a larger scale and partly in section, a view of the end of the intermediate- or extension piece in FIGS. 1 and 2.

The embodiment shown on the Drawings of a device according to the present invention will be described in greater detail hereinbelow in connection with an intermediate- or extension piece illustrated in FIGS. 1-3, which is also designated a middle yoke, frame, etc. The same reference numerals in the different Drawing figures relate to the same parts.

The intermediate- or extension piece has four legs 1-4 which are disposed on the ends of an end beam 5, 6. The end beams 5, 6 are interconnected to one another by means of a web beam 7 which may be fixed or, as in the illustrated embodiment, be telescopical and is constructed from two beams disposed beside one another. The telescoping of the web beam 7 is facilitated by means of rollers 8 and 9. The end walls 5 and 6 are further interconnected with one another via the intermediary of a telescopic shaft 10. The legs 1-4, the end beams 5, 6 and the web beam 7 consist of tubular beams, for example square tubular configuration.

Figure 5:
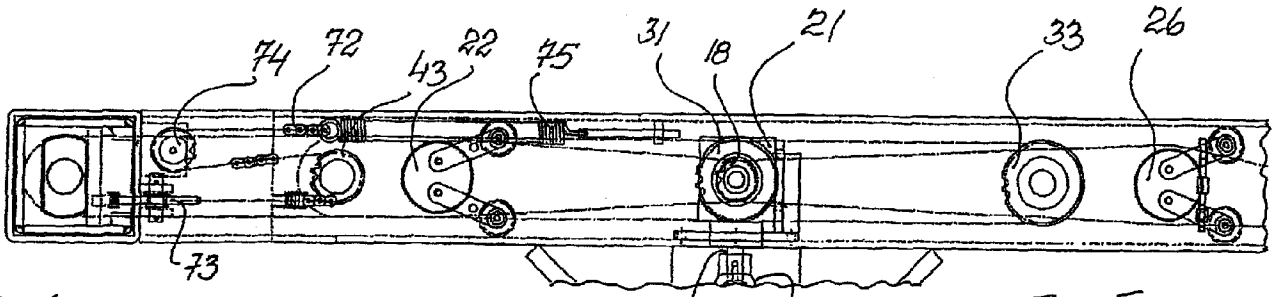
FIG. 5 is a top plan view of the part illustrated in FIG. 4.
Figure 4:
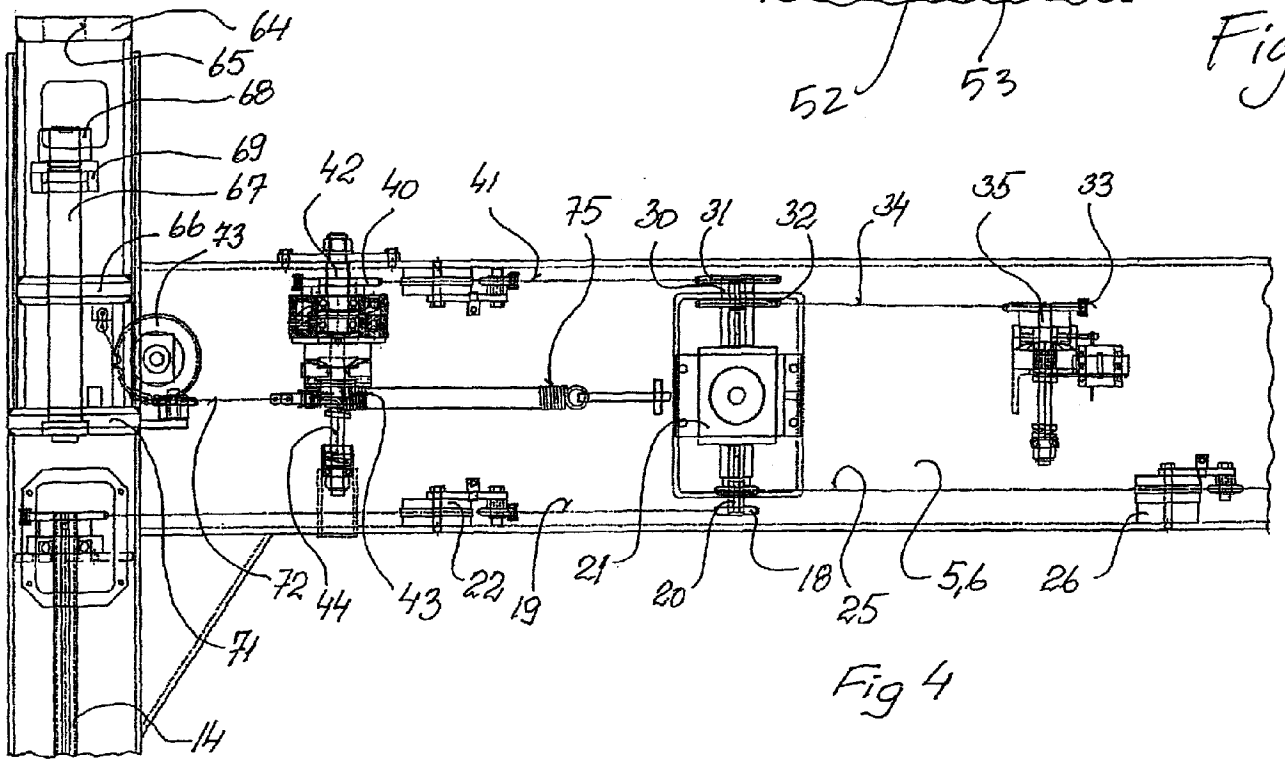
FIG. 4 shows, in section and on a larger scale, the upper, left-hand corner of the end wall of the intermediate- or extension piece in FIGS. 1-3.

The end beams 5, 6 are shown in greater detail in FIG. 4. The diagonally placed legs 1, 3 are provided upwardly with a hole 65 for a twist locking pin which is part of a goods handling or hoisting device of the yoke or spreader type and which is of per se known type and displays two locking heels diametrically projecting from a round stub shaft, these imparting an elongate form to the twist locking pin. As is apparent in FIG. 2, the hole 65 displays the same oblong configuration as the twist locking pin. At the lower end of the leg 1, 3 and also the leg 2, 4, there is disposed a twist locking pin 13 of substantially the same configuration as the twist locking pin on the goods handling or hoisting equipment. The twist locking pins 13 are disposed on the end of a shaft 14 which consists of two telescopic profile rods which are displaceable axially in relation to the shaft 14 against the action of a spring 15. In the illustrated position, the twist locking pins 13 are rotary but are axially insertable in the legs 1, 3 and 2, 4 against the action of the spring 15 and, in the inserted position, the twist locking pins come into engagement with a locking pin 16. The shaft 14 in the leg 1, 3 displays, at the opposite end in relation to the twist locking pin 13, a chain sprocket 17. The shaft 14 is suitably journalled at both ends on a suitable middle plate in the leg 1, 3. The chain sprocket 17 is connected to a chain sprocket 18 by means of a gear sprocket chain 19. The chain sprocket 18 is secured on a shaft 20 from a transmission 21. Between the chain sprocket 17 and the chain sprocket 18, there is disposed a gear tensioner 22 which may be of the type illustrated in FIG. 5 and which has two pivotal arms each with a roller for urging against the chain 19 by means of a screw which extends between threaded pivotal anchorages on the arms which are fixed on a circular disc against which the chain 19 runs. The rollers and the disc may be manufactured from a suitable plastic material, for example nylon.

At its opposing end in relation to the twist lock pin 13, the shaft 14 in the leg 2, 4 supports a chain sprocket 23 and, like the shaft 14 in the leg 1, 3, is journalled at both ends on suitable middle plates in the leg 2, 4. The chain sprocket 23 is interconnected to a chain sprocket 24 on the shaft 20 from the transmission 21 via a sprocket chain 25 which extends via a chain tensioner of substantially the same type as the tensioner 22. The sprocket chain 25 extends further via a chain sprocket 27 on an input shaft 28 to an indicator device 29. This is arranged so that it twists or pivots a flag 80, preferably through 180° on twisting of the twist locking pins through 90°. The flag 80 is advantageously in the form of a cylinder with a part of the circumferential surface and a part of the end surface in one colour and another part of the circumferential surface and another part of the end surface in a different colour. In one embodiment, it has proved to be appropriate to provide half of the cylinder in a red colour and the other half in a green colour for indicating one or the other position of the locking pins. The illustrated part or colour is visible both from above and the sides.

The input shaft 30 of the transmission 21 supports two chain sprockets 31 and 32 of which the chain sprocket 32 is connected to a chain sprocket 33 by means of a gear chain 34. The chain sprocket 33 is disposed on a shaft 35 on a positioning mechanism and includes a cam disc. The cam disc has two troughs each for a roller. The roller is secured on the end of a pin which in turn is secured on the shaft 35. The pin, or the shaft, may extend through the shaft 35 and, at its other end, support an identical roller for the second trough in the gear disc 36. The shaft 35 is axially displaceable in the cam disc and is urged towards the illustrated position with the aid of a spring. This implies that the rollers will always strive to assume their position in the troughs, which in turn implies that the shaft 35 is pivoted through 180° between the troughs. This rotation is transferred by means of the gear chain 34 to the chain sprocket 32 and the shaft 30 to the transmission 21.

The chain sprocket 31 is connected to a chain sprocket 40 by means of a gear chain 41. This chain 41 is kept tensioned by means of an identical tensioner to the tensioner 22 for tensioning the chain 19. The chain sprocket 40 is secured on a shaft 42 in a locking mechanism of the type which has a function similar to a locking key and permits rotation of the shaft 41 only clockwise, as shown in FIG. 4, on rotation of the shaft 42 by means of a chain sprocket 43 on an input shaft to the mechanism on a shaft 44. On rotation of the shaft 44 clockwise by means of the chain sprocket 43, the output shaft 42 with the chain sprocket 40 will be rotated clockwise while rotation of the chain sprocket 43 and the shaft 44 counter-clockwise will not entail any rotation of the shaft 42 and the chain sprocket 40, since counter-clockwise rotation of the locking mechanism does not involve any rotational engagement between the parts therein.

The locking mechanism also includes a torque limiter. The locking mechanism and torque limiter are shown in greater detail in FIGS. 6 and 7. The torque limiter is in the form of two mutually axially displaceable discs with cup-shaped mutually facing surfaces which are urged against one another by means of a spring, the coupling between the discs being broken when the rotational force exceeds a given, predetermined value in that, in other words, the discs are urged apart against the action of the spring and slip in relation to one another.

Each leg 1-4 is provided upwardly with a part 60-63 which is telescopic in the leg and upwardly is provided with a plate 64 with a recess 65 for passage of a twist locking pin on a goods hoisting or handling device which, after rotation through 90° by suitable means in a goods hoisting or handling device cannot be passed through the recess 65 in the plate 64 but are located in the locking position. The part 60-63 is insertable in the leg by means of the goods handling or hoisting device in that this is placed on the intermediate- or extension part and forces in the parts 60-63 in the legs 1-4 to an inner position. Each part 60-63 has an inner plate 66 which is secured on the inner end of the telescopic part 60-63. A rod 67 is secured in the leg 64 and extends through the inner plate 66. The part extending through the plate 66 is provided with arrest means in the form, for example, of a nut 68 and a bridge 69. The arrest means 68, 69 restrict the withdrawal of the part 60-63 out of the legs 1-4, whereby the intermediate- or extension part, with a possible load, may be hoisted by means of the goods handling or hoisting device after locking of its twist locking pins in the recess 65. The inner plate 66 is provided on three sides with plates 70 so that an opening is formed towards the interior of the beam 5, 6. On insertion of the part 60-63 in the leg 1-4, the plates 70 may be dimensioned so as to come into contact with the anchorage device 71 provided for anchoring the rod 67, the anchorage device may be a plate of the same type as the plate 66 and thereby also form a stop for the insertion of the part 60-63 in the leg 1-4 as well as the inner position of the part 60-63. The telescopic parts 60-63 are thus switchable between the outer position illustrated in FIG. 6 and the inner position in which the plates 70 come into contact with the anchorage device or the plate 71, as shown exemplarily in FIG. 4.

In the inner plate 66, there is secured one end of a gear- or tooth sprocket chain 72 which extends over the chain sprocket 73 which is mounted vertically on the inside of the opening to the end beam 5, 6, over the chain sprocket 43 on the shaft 44 to the torque limiter and locking mechanism, and over a bending sprocket 74 to the end of a draft spring 75 which, in FIG. 4, is shown compressed but should have been shown extended, since the draft spring 75 serves for keeping the chain 72 taut regardless of whether the part 60 is in the inserted or withdrawn position. The opposite of the draft spring 75 in relation to the chain is anchored in the end beam by means of a suitable fixing device.

On switching (withdrawal) of the part 60 from the inserted position to the withdrawn position, the gear chain 72 will drive the chain sprocket 43. This rotation of the chain sprocket 43 will be transferred to the locking mechanism on condition that the torque is less than a predetermined value, whereby the rotation will be propagated to the twist pin 13 in the second end leg 2 via the transmission 21 and the gear chain 25 as well as the parts driven thereby and the twist locking pin 13 in its so-called own leg 1 via the transmission 21 and the gear chain 19 as well as the parts driven thereby, and to the output shaft 52 which leads to the transmission 21 in the second end 6.

In that the goods handling or hoisting device is utilised for switching the parts 60-63 both from the projecting position to the inserted position and, above all, from the inserted position to the projecting position, the force which is required for switching of the twist locking pins 13 on the ends of the legs 1-4 will always be available even though this is limited by the torque limiter.

If any of the twist locking pins 13 is not in position to be able to be switched (twisted) for any reason, the requisite twisting torque will be exceeded, whereby the torque limiter does not transfer the force from the gear chain 72 to the locking mechanism. This implies solely that the goods handling or hoisting device is utilised for displacement or adjustment of the position of the intermediate- or extension piece.

Thereafter, the goods handling or hoisting device is caused to shift in the parts 60-63 with a view to attempting a new switching- or twisting operation, which may continue until such time as both of the indicator devices 29, 80 indicate a correct position of the twist locking pins 13.

The transmission 21 is further a mitre wheel gear which includes a mitre wheel on the input shaft 30, a mitre wheel on the output shaft 52 and a mitre wheel cooperating with these two mitre wheels and lying interjacent and also being secured on the output shaft at a right angle to the two other shafts. The output shaft 52 is connected via a universal joint 53 to the telescopic shaft 10 for interconnection with a mitre wheel gear 21 in the second end of the device.

As a result of the device according to the present invention, the transfer of telescopic movement of the parts 60-63 by means of the goods handling or hoisting device with parts 72, 73, 44, 21, etc. included in the twisting or rotation mechanism to the twist locking pins 13 as it were rigid and positive and the twisting of the twist locking pins 13 will only take place if, as it were, everything is correct. If any of the twist locking pins 13 is not located in the correct position for locking in a corner box on a flat or a container, the torque limiter will counteract transfer of the torque from the chain 72 to the chain 41 and the remaining power transmission chains included in the drive train via the transmission 21. The interconnection of the transmissions or the mitre wheel gears 21 with the aid of the shaft 10 via the universal joint 53 will also counteract and prevent twisting of any of the twist locking pins 13 if any of the twist locking pins 13 in any of the legs 1-4 is locked and cannot be twisted.

It should further be observed that the gear ratio between the chain sprocket 47 and the chain sprocket 43 is approximately 90° to 180-200°, while the gear ratio between the chain sprockets 31 and 32 and the chain sprockets 18 and 24 is substantially the same, which implies that a rotation through 180° of the chain sprockets 31 and 32 entails a 90° rotation of the chain sprockets 18 and 24, this rotation being transmitted to the chain sprockets 17 and 23 for twisting the twist locking pins 13 through 90°. This twisting movement is also transmitted to the indicator device 29 which pivots the flag 30 through 180°.

Figure 6:
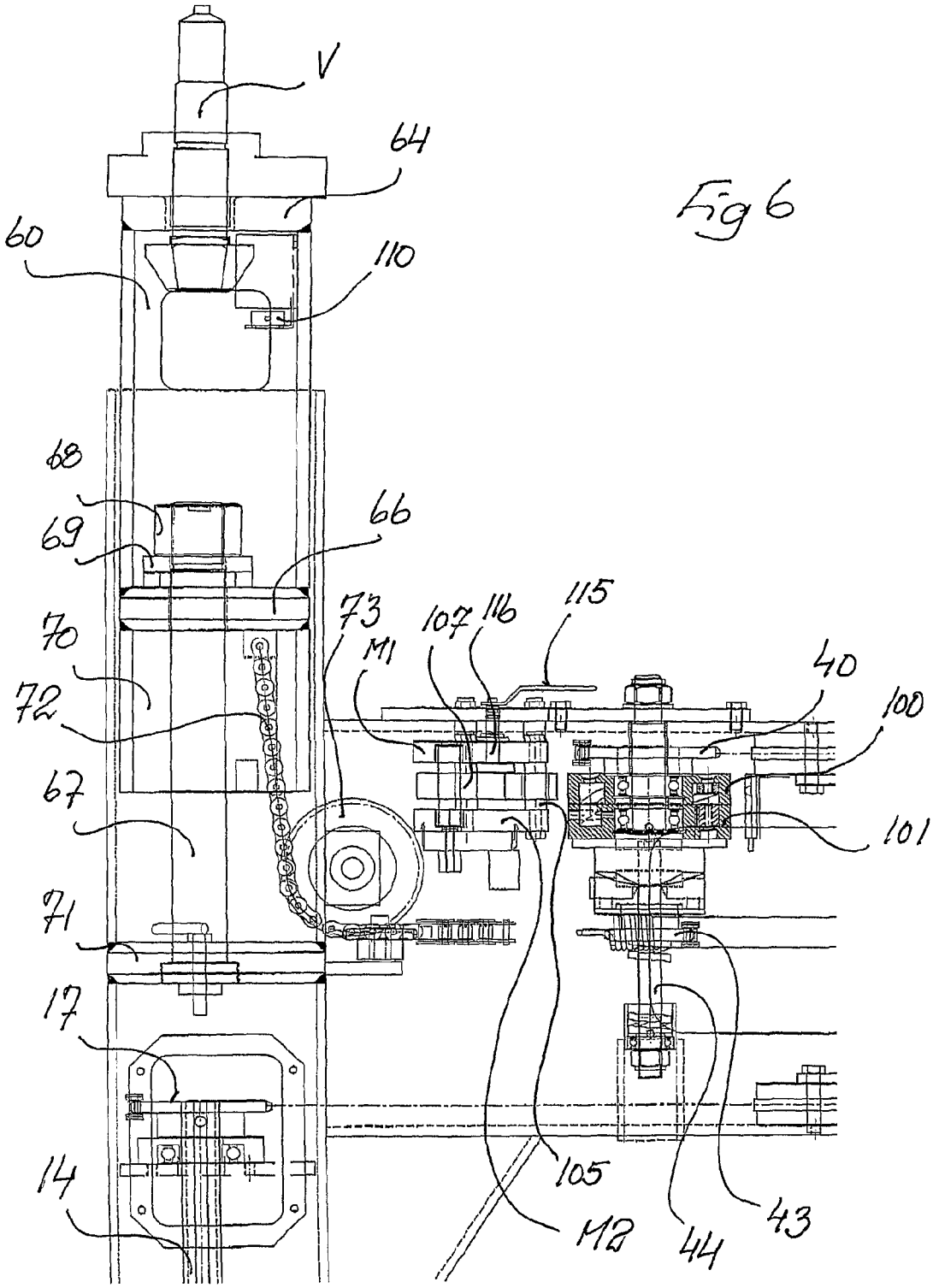
FIG. 6 shows a similar section to that of FIG. 4 of a modification of the device according to the present invention.
Figure 7:
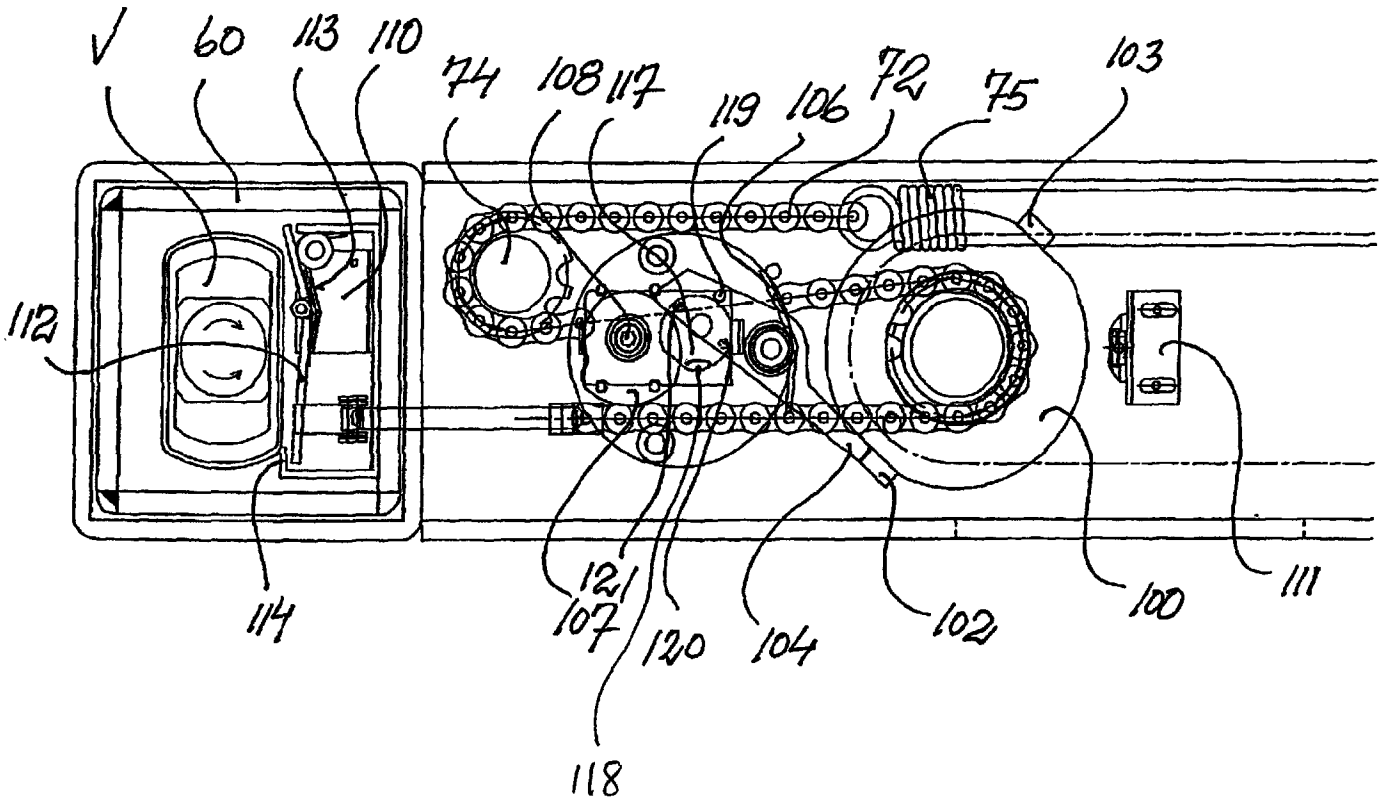
FIG. 7 is a top plan view of the part illustrated in FIG. 6 with the components in one position.
Figure 8:
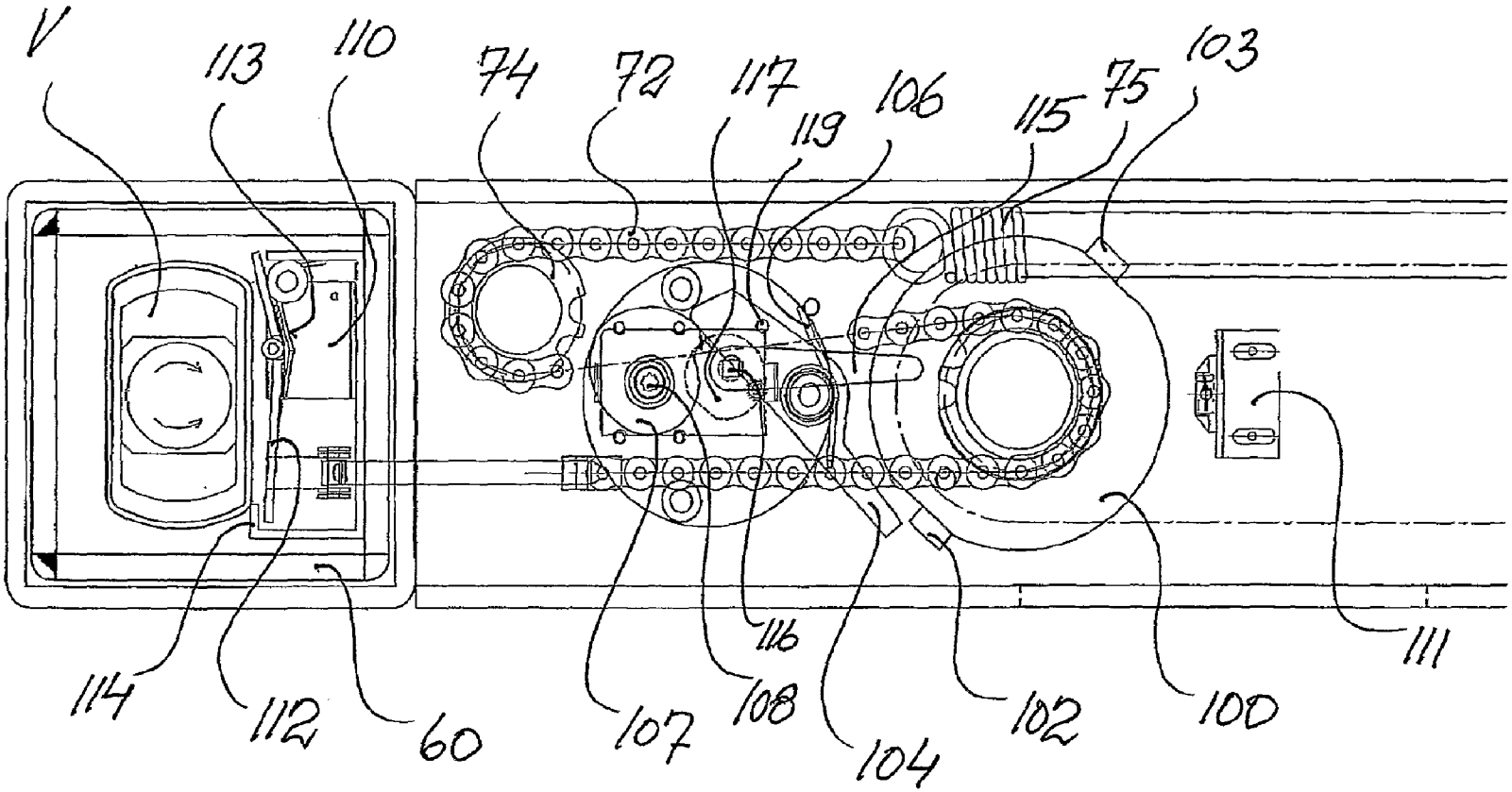
FIG. 8 shows the part illustrated in FIG. 7 with the components in another position.

FIGS. 6-8 show a modification of the above described device according to the present invention. The locking mechanism disposed between the chain sprockets 40 and 43 is, as was mentioned above, of per se known type and includes an upper disc 100 which is secured on the shaft 42 and a lower disc 101 which is secured on a part extending from the torque limiter, which is rotated by means of the chain sprocket 43 only if the torque is less than a predetermined value. The upper disc 100 is provided with two locking heels 102, 103 each on a flat surface which are located in register with one another on the circumferential surface of the upper disc 100. The one locking heel 102 is in engagement with the one end of a locking arm 104 which is journalled on a stub shaft 105 extending between two mounting discs M1 and M2 in order to be pivotal between the illustrated locking position, towards which locking position on the locking arm 104 of the upper disc 100 is spring biased by means of a spring 106. The opposite end of the locking arm 104 in relation to the upper disc 100 rests against a cam disc 107 which is coupled to a drive unit and which is fixed on the output shaft 108 from the drive unit. The drive unit includes a gear with a motor which is arranged to pivot the cam disc 107 fixed on the shaft 108 through approx. 180° or one and a half turns at a time. The shaft 108 extends between the mounting discs M1 and M2 and supports the cam disc 107 between the discs M1 and M2. The motor is energised by means of a PLC circuit which is included in the drive unit, together with possible additional electronics and which receives signals from position indicators 110 and 111. The drive unit is mounted on the underside of the mounting disc M2.

With the cam disc 107 in the downwardly directed position illustrated in FIG. 7, the locking arm 104 will, by means of the spring 106, be pivoted towards the circumferential surface of the upper disc 100 to the illustrated locking position for engagement with the locking heel 102 or 103, depending upon which of the locking heels 102, 103 is located in a suitable position. In this position, rotation of the upper disc 100 is prevented, and thereby switching of the twist locking pins 13.

The one position indicator 110 is located beneath a flap 112 which is mounted on the inside of the hole 65 in the leg 60 in order to be pivotal by means of the twist locking pin V on the goods handling or hoisting device or the parent yoke, by means of which the intermediate- or extension piece is to be hoisted with or without a load. On switching of the twist locking pin V to the locking position, the twist locking pin V will pivot the flap 112 against the action of a spring 113. The spring 113 urges the flap 112 towards the position of rest illustrated on the Drawing figures against the flange 114 when the twist locking pin V is located in the open position. Switching of the flap 112 from that position to which the flap 112 had been pivoted by means of the twist locking pin V in the locked position of the twist locking pin V will cause the position indicator 110 to emit a signal to the PLC circuit and cause it to supply the motor for pivoting the cam disc 107 from the downwardly directed position illustrated in FIG. 7 to the upwardly directed position illustrated in FIG. 8 and simultaneous engagement with the locking arm 104 for pivoting thereof to the position illustrated in FIG. 8, in which the locking heel 102 will be free to be displaced passed the end of the locking arm 104 so that the upper disc 100 will in its turn be free to be rotated from switching of the twist locking pins 13 on switching of the telescopic part 60 out of the leg 1 on the intermediate piece. As soon as the flap 112 leaves the position indicator 100 located on the underside of the flap 112 and positions itself in the starting position in engagement against the flange 114. On rotation of the upper disc 100, the locking heel 102 or 103 will pass the position indicator 111, which emits a signal to the PLC circuit to cause it to supply the motor for pivoting the shaft 108 and thereby the cam disc 107 back to the downwardly directed position in FIG. 7 and thereby permit pivoting of the locking arm 104 by means of the spring 106 to the locking position in FIG. 7 for engagement with the locking heel 103.

In the event that the telescopic part 60 is not switched and, as a result, the locking arm 104 remains in its non-locking position without engagement with any of the locking heels 102, 103, the PLC circuit is configured, after a desired predetermined period of time, to cater for the switching to the locking position. After the expiration of the desired period of time of X number of seconds, the PLC circuit will supply the motor for switching the cam disc 107 to the downwardly directed position in FIG. 7 and thereby for pivoting of the locking arm 104 by means of the spring 106 to the locking position in FIG. 7 for engagement with one of the locking heels 102, 103. The PLC circuit is fed from a suitable current source, for example a battery, solar cell package or the like.

The locking arm 104 is switchable manually with the aid of a handle 115 which is shown in FIGS. 6 and 8 and is secured on a shaft 116 which is journalled in the upper mounting disc M1 and supports a cam disc 117 between the mounting discs M1 and M2. The cam disc 117 displays a flat surface 118 in register with a pin 119 on the locking arm 104. After switching of the cam disc 117 half of a turn by means of the handle 115, the flat surface comes into contact with the pin 119 and pivots the locking arm 104 to the non-locking position. The cam disc 117 further supports two positioning pins 120 and 121 for determining the position of the cam disc 117.

The position indicators 110 and 111 may suitably be of inductive type but it is also conceivable to provide other types of position indicators.

The modification of the device according to the present invention described with reference to FIGS. 6-8 considerably improves safety in that an unintentional release of the load is avoided entirely, since the twist locking pins 13 on the intermediate piece cannot be switched unless the twist locking pins V on the goods handling or hoisting device or parent yoke have been switched from the locked to the open position and thereafter back to the locked position for releasing the locking arm 104 from any of the locking heels 102, 103 so that it will be possible to rotate the disc 100 in that the telescopic part 60 is drawn out of the leg, which results in the twist locking pins 13 being switched from locking position to open position or from open position to locking position.

Many modifications are naturally possible without departing from the inventive concept as defined in the appended Claims.

The invention claimed is:

1. In intermediate- or extension pieces for interconnecting with a goods handling device, a device for permitting handling or hoisting of goods platforms with corner boxes for cooperation with twist locking pins in the goods handling or hoisting device, said intermediate- or extension pieces comprising a beam arrangement in a form of two mutually interconnected ends with a leg at each end, a twist locking pin provided in each leg, wherein there is disposed, at one end of each leg, a part switchable in a direction up out of the leg, for actuating a mechanism for twisting the twist locking pin in the leg upon a switching of said part in a direction up out of the leg.

2. The device as claimed in claim 1, wherein each end comprises a twisting mechanism for switching the twist locking pins in the legs.

3. The device as claimed in claim 2, wherein the twisting mechanism includes a locking means which prevents a switching of the twist locking pins.

4. The device as claimed in claim 3, wherein the locking means includes a locking arm which is pivotal by means of a motor with a cam disc between a locking position and a free position in which switching of the twist locking pins is permitted.

5. The device as claimed in claim 4, wherein a sensor is configured to sense movement of the twisting mechanisms for switching of the twist locking pins in order to realise switching of the locking arm to the locking position.

6. The device as claimed in claim 3, wherein said locking means include a sensor which is configured to sense switching of the twist locking pins of the goods handling or hoisting device from a locked position to an open position, in order to cater for a switching of a locking arm to the free position during at least a predetermined period of time during which switching of the twist locking pins is permitted by switching of the switchable parts.

7. The device as claimed in claim 1, wherein the switchable part at one leg of the two mutually interconnected ends is coupled to the twisting mechanism, while the switchable part at the other leg of the two mutually interconnected ends is free-going.

8. The device as claimed in claim 1, wherein diagonal switchable parts are interconnected with the twisting mechanisms, which are interconnected to one another for a synchronous twisting of the twist locking pins in the legs.

9. The device as claimed in claim 1, wherein the switchable parts comprise telescopic parts at the upper end of the legs.

10. The device as claimed in claim 9, wherein the switchable parts are insertable in the legs to a first position and withdrawable out of the legs to a second position, in which the parts are supportingly interconnected with the legs.

11. The device as claimed in claim 1, wherein a gear wheel chain forms a communication between the switchable part and the twisting mechanism.

12. The device as claimed in claim 11, wherein one end of the gear wheel chain is secured in the switchable part, while the other end is secured in an end beam via a tensioning device.

13. The device as claimed in claim 12, wherein the gear wheel chain is in a driving engagement with an input shaft to a torque limiter which permits twisting of the twist locking pins at a lower torque on the input shaft than a predetermined value, and prevents twisting of the twist locking pins if the predetermined torque is exceeded.

14. The device as claimed in claim 1, wherein the switchable parts are provided with recesses for receiving twist locking pins in a goods handling or hoisting device which, after locking in the switchable parts, permits displacement of the switchable parts between a first position and a second position and, thereby, rotation of the twist locking pins in the legs via a gear wheel chain and the twisting mechanisms.

15. A device for handling or hoisting of goods platforms, said device comprising:

a beam arrangement comprising two mutually interconnected end beams, each said end beam comprising a leg at each end thereof, for a total of four legs in said beam arrangement, each said leg having a corner box at a top end thereof, for cooperation with twist locking pins in a goods handling or hoisting device; and a twist locking pin provided in each leg at a bottom end thereof, for cooperation with goods platforms, wherein, said corner box at said top of said each leg comprises a part switchable in a direction up out of the leg, for actuating a mechanism for twisting the twist locking pins in the bottom of the legs upon a switching of said part in a direction up out of the leg, to thereby attach said device to a goods platform when said device is hoisted upward.

16. The device of claim 15, wherein said mechanism for twisting the twist locking pins does not twist any of said twist locking pins if any said twisting locking pin is not free to rotate.

17. The device of claim 15, wherein said mechanism for twisting the twist locking pins further controls a display that indicates positions of said twisting locking pins.

18. The device of claim 15, wherein said mechanism for twisting the twist locking pins comprises a transmission box and said switchable parts and said twist locking pins are flexibly interconnected via said transmission box.

19. The device of claim 15, wherein said mechanism for twisting the twist locking pins comprises a torque limiter that prevents a twisting of any of the twist locking pins if any of the twist locking pins of any of the legs is locked and cannot be twisted.

20. A method of handling or hoisting of goods platforms, said method comprising:

placing an intermediate lifting device over a goods platform, said intermediate lifting device comprising a beam arrangement comprising two mutually interconnected end beams, each said end beam comprising a leg at each end thereof, for a total of four legs in said beam arrangement, each said leg having a corner box at a top end thereof, for cooperation with twist locking pins in a goods handling or hoisting device, and a twist locking pin at a bottom end thereof, for cooperation with goods platforms; and lifting said goods platform by lifting said intermediate lifting device, using said goods handling or hoisting device, wherein, said corner box at said top of said each leg of said intermediate lifting device comprises a part switchable in a direction up out of the leg, for actuating a mechanism for twisting the twist locking pins in the bottom of the legs upon a switching of said part in a direction up out of the leg, to thereby attach said intermediate lifting device to said goods platform when said lifting device is hoisted upward by said goods handling or hoisting device.

* * * * *